US009073197B2

(12) United States Patent
Yamauchi

(10) Patent No.: US 9,073,197 B2
(45) Date of Patent: Jul. 7, 2015

(54) VIBRATION REDUCTION HANDLE AND POWER TOOL

(75) Inventor: Ken Yamauchi, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 601 days.

(21) Appl. No.: 13/396,061

(22) Filed: Feb. 14, 2012

(65) Prior Publication Data

US 2012/0211250 A1 Aug. 23, 2012

(30) Foreign Application Priority Data

Feb. 17, 2011 (JP) ..... 2011-032454

(51) Int. Cl.

| | |
|---|---|
| ***B25D 17/24*** | (2006.01) |
| ***B25D 17/00*** | (2006.01) |
| ***B25F 5/00*** | (2006.01) |
| ***B25F 5/02*** | (2006.01) |

(52) U.S. Cl.

CPC ..... *B25F 5/006* (2013.01); *B25F 5/026* (2013.01)

(58) Field of Classification Search

CPC ..... B25D 17/24; B25D 17/00; B25D 17/043; B25F 5/006; B25F 5/026; B25F 5/02

USPC ..... 173/162.1, 162.2, 170; 16/430–431, 16/436, 110 R

See application file for complete search history.

(56) References Cited

U.S. PATENT DOCUMENTS

| | | | | |
|---|---|---|---|---|
| 5,052,500 | A * | 10/1991 | Ohtsu | 173/162.2 |
| 5,157,807 | A | 10/1992 | Keller et al. | |
| 7,137,542 | B2 * | 11/2006 | Oki et al. | 173/162.2 |
| 2006/0219419 | A1 | 10/2006 | Sugiyama et al. | |

FOREIGN PATENT DOCUMENTS

| | | | |
|---|---|---|---|
| DE | 40 11 124 | A1 | 10/1991 |
| DE | 10 2007 062 715 | A1 | 7/2009 |
| DE | 10 2008 004 875 | A1 | 7/2009 |
| EP | 0 995 553 | A2 | 4/2000 |
| EP | 2 218 555 | A1 | 8/2010 |
| EP | 2 251 152 | A1 | 11/2010 |
| JP | S-55-45430 | | 3/1980 |
| JP | A-01-281881 | | 11/1989 |
| JP | A-2006-289562 | | 10/2006 |
| WO | WO 2009/083338 | A1 | 7/2009 |
| WO | WO 2009/089961 | A1 | 7/2009 |

OTHER PUBLICATIONS

Nov. 6, 2013 Search Report issued in European Application No. 12155824.1.

Jul. 28, 2014 Office Action issued in Japanese Patent Application No. 2011-032454 (with English translation).

* cited by examiner

*Primary Examiner* — Michelle Lopez

(74) *Attorney, Agent, or Firm* — Oliff PLC

(57) ABSTRACT

A vibration reduction handle includes: a handle body attachable to a disk grinder; a grip portion which extends in a first direction defined as a longitudinal direction of the grip portion and is pivotably movable in a second direction crossing the first direction; and a first vibration reduction rubber and a second vibration reduction rubber which are respectively provided between the handle body and the grip portion.

12 Claims, 8 Drawing Sheets

VIBRATION REDUCTION HANDLE AND POWER TOOL

CROSS REFERENCE TO RELATED APPLICATION

The present application claims priority from Japanese Patent Application No. 2011-032454, filed on Feb. 17, 2011, the disclosure of which is incorporated herein by reference in its entirety.

FIELD OF THE INVENTION

The invention relates to a vibration reduction handle used by a user to which is attached a power tool, and the power tool having the vibration reduction handle.

BACKGROUND OF THE INVENTION

Japanese Unexamined Patent Application Publication No. 2006-289562 discloses a vibration reduction handle of a grinder as a hand-held power tool. The vibration reduction handle comprises a handle body, a cylindrical grip portion and a vibration reduction rubber. The handle body is made of metal and detachable to the hand-held power tool. The cylindrical grip portion is made of plastic and rotatably connected to the handle body via a rounded surface. The vibration reduction rubber is defined as an elastic member biasing the cylindrical grip portion in a state that the cylindrical grip portion rotates against the handle body. Therefore, a vibration from the handle body to the cylindrical grip portion is reduced by means of the vibration reduction rubber.

Regarding the vibration reduction handle described above, when the cylindrical grip portion is biased by a bending force and rotated around the rounded surface, a forward part of the vibration reduction rubber with respect to a direction of a rotation is compressively deformed and therefore the vibration reduction rubber reduces the vibration. However, reducing the vibration by means of the vibration reduction rubber is not attained by a tensional deformation but a compressional deformation. In this point, as to the vibration reduction rubber described above, a backward part of the vibration reduction rubber with respect to the direction of the rotation is stretched, therefore the tensional deformation is wasted to obtain a vibration reduction effect effectively. Namely, because the vibration reduction rubber is only partially compressively deformed, the vibration reduction effect is inefficient.

SUMMARY OF THE INVENTION

Problem to be Solved by the Invention

An object of the invention is, in consideration of the above described problem, to provide a vibration reduction handle and a power tool having the vibration reduction handle which further improve a vibration reduction effect.

Means for Solving the Problem

Above-mentioned object is achieved by the claimed invention. According to a preferred aspect of the invention, a vibration reduction handle attachable to a power tool is provided. The vibration reduction handle comprising: an attachment portion attachable to a power tool; a grip portion which extends in a first direction defined as a longitudinal direction of the grip portion and is pivotably movable in a second direction crossing the first direction; and a first elastic member and a second elastic member which are respectively provided between the attachment portion and the grip portion. The attachment portion has a grip connecting portion which engages with the grip portion and has a first wall. The grip portion has an attachment connecting portion which engages with the attachment portion and has a second wall. Further, one component among the grip connecting portion and the attachment connecting portion is disposed inside the other component, and the first wall and the second wall face to each other, and said one component has a flange which protrudes along the second direction toward the other component, and the other component has a third wall which faces respectively both surfaces of the flange with respect to the first direction. Further, the first elastic member and the second elastic member are respectively disposed at both sides of the flange with respect to the first direction and clamped by the first wall and the second wall in the second direction and clamped by the flange and the third wall in the first direction. Further, the grip portion includes a pivot against the attachment portion disposed between the first elastic member and the second elastic member with respect to the first direction. Further, the flange of the aspect preferably includes either a continuously extending wall in a circumference direction or a plurality of walls which frequently or irregularly align in a circumference direction.

According to a further preferable aspect of the invention, the grip connecting portion is disposed inside the attachment connecting portion. And the flange is provided on the grip connecting portion and protrudes toward the attachment connecting portion. Further, the third wall is provided on the attachment connecting portion.

In the further preferable aspect, the first and second elastic rubber are clamped between the first wall and the second wall in the second direction crossing the first direction, further, the first and second elastic rubber are clamped between the flange arranged on the attachment portion and the third wall arranged on the grip portion. Therefore, in a state that the grip portion pivots against the attachment around the pivot which is disposed between the first elastic member and the second elastic member with respect to the first direction, the grip portion is exerted in the second direction. Therefore, both one side parts of the first and second elastic member with respect to a surface including the first direction and crossing the second direction are respectively compressed by the first wall and the second wall in the second direction. Further both the other side parts of the first and second elastic member are respectively compressed by the flange and the third wall in the first direction. In this way, according to the preferable aspect, substantially whole parts of the first and second elastic member are compressed. Namely, because substantially whole parts of the first and second elastic member are compress and reduce a vibration, a vibration reduction effect is improved. As a result, each volume of the first and second elastic member is decreased respectively. Therefore, the vibration reduction handle is lightened and downsized.

Further, according to another preferable aspect of the invention, the attachment connecting portion is disposed inside the grip connecting portion. And the flange is provided on the attachment connecting portion and protrudes toward the grip connecting portion. Further, the third wall is provided on the grip connecting portion.

In the another preferable aspect, the first and second elastic rubber are clamped between the first wall and the second wall in the second direction crossing the first direction, further, the first and second elastic rubber are clamped between the flange arranged on the attachment portion and the third wall arranged on the grip portion. Therefore, in a state that the grip portion pivots against the attachment around the pivot which is disposed between the first elastic member and the second elastic member with respect to the first direction, the grip portion is exerted in the second direction. Therefore, both one side parts of the first and second elastic member with respect to a surface including the first direction and crossing the second direction are respectively compressed by the first wall and the second wall in the second direction. Further both the other side parts of the first and second elastic member are respectively compressed by the flange and the third wall in the first direction. In this way, according to the preferable aspect, substantially whole parts of the first and second elastic member are compressed. Namely, because substantially whole parts of the first and second elastic member are compress and reduce a vibration, a vibration reduction effect is improved. As a result, each volume of the first and second elastic member is decreased respectively. Therefore, the vibration reduction handle is lightened and downsized.

According to a further aspect of the invention, the first elastic member and the second elastic member are provided as other component separately each other. According to the aspect, because the first elastic member and the second elastic member are provided as other component separately, the first elastic member and the second elastic member is easily assembled at one side and the other side of the flange respectively.

According to a further aspect of the invention, the first wall and the second wall exert a compression force against the first elastic member and the second elastic member in a state that the grip portion pivots against the attachment portion. Further, according to a further aspect of the invention, the third wall exerts a compression force against the first elastic member and the second elastic member in a state that the grip portion pivots against the attachment portion. According to the aspect described above, the first elastic member and the second elastic member are substantially compressively deformed, namely a shear deformation is hardly occurred, and therefore a degradation of each elastic member is decreased effectively.

According to a further aspect of the invention, the attachment portion and the grip portion are distantly positioned and connected to each other via the first elastic member and the second elastic member. According to the aspect, because the attachment portion and the grip portion are arranged separately each other and the attachment portion and the grip portion are connected to each other via only the first elastic member and the second elastic member, in an area other than where the first elastic member and the second elastic member are arranged, the attachment portion and the grip portion are separated from each other (called floating support). Therefore, a directly-transmission of vibration from the attachment portion to the grip portion is decreased.

According to a further aspect of the invention, the grip portion has a grip body which extends in the first direction and which connects to the attachment connecting portion. Further, the grip portion has a flange portion which is disposed between the attachment connecting portion and the grip body. According to the aspect, because the flange portion is disposed between the attachment portion and the grip body with respect to the first direction, the grip body is located distantly from the attachment portion with respect to the first direction. Therefore, a damping effect of a vibration of the grip body 133 is effectively improved.

Further, according to another preferable aspect of the invention, a vibration reduction handle attachable to a power tool is provided. The vibration reduction handle comprising: an attachment portion which attachable to a power tool; a grip portion which extends in a first direction defined as a longitudinal direction of the grip portion and is pivotably movable in a second direction crossing the first direction; and a first elastic member and a second elastic member which are provided between the attachment portion and the grip portion. The first elastic element and the second elastic element are substantially aligned to each other along the first direction. The grip portion includes a pivot against the attachment portion disposed between the first elastic member and the second elastic member with respect to the first direction. Further, the attachment portion and the grip portion exert a compression force against both of the first elastic member and the second elastic member in a state that the grip portion pivots.

According to a further aspect of the invention, a power tool has the vibration reduction handle according to any one claims 1 to 9. Accordingly, a power tool having the vibration reduction handle which is highly effective to improve a vibration reduction effect and to lighten and downsize the power tool, is provided.

According to the invention, a vibration reduction handle and a power tool having the vibration reduction handle which further improve a vibration reduction effect are provided. Other objects, features and advantages of the present invention will be readily understood after reading the following detailed description together with the accompanying drawings and the claims.

DESCRIPTION OF THE PREFERRED EMBODIMENTS

Figure 1:
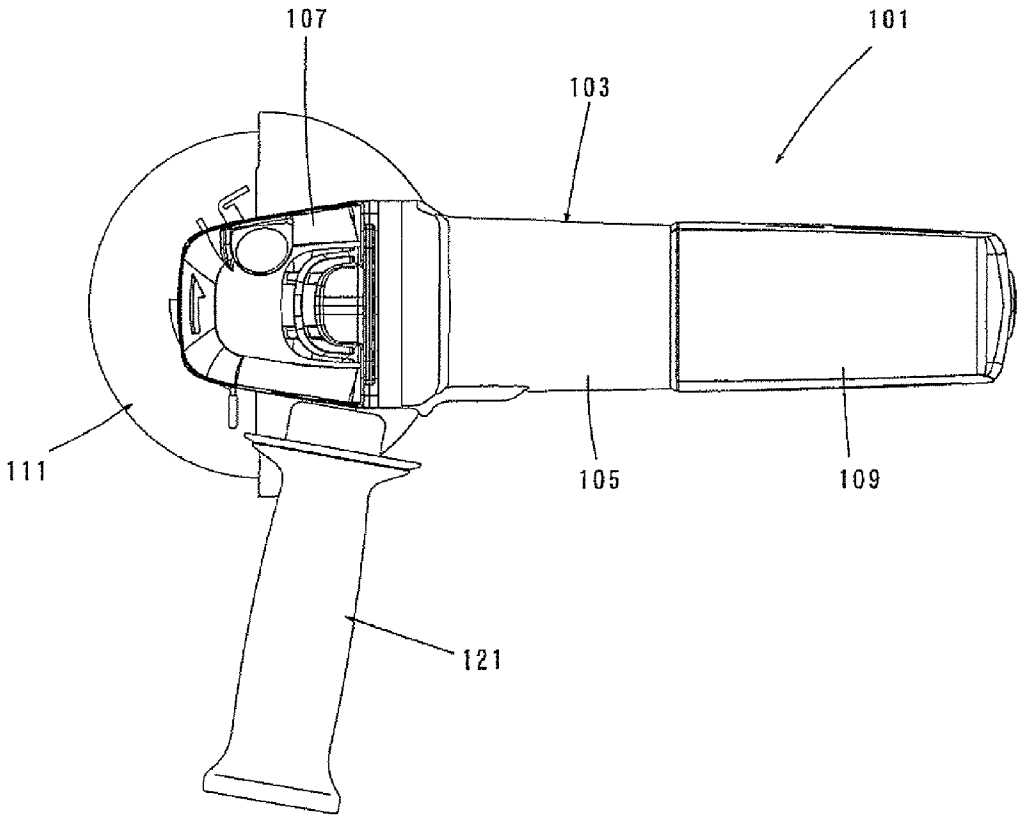
FIG. 1 shows a top view of a total composition of a disk grinder being attached a side handle in accordance with an embodiment of the invention.
Figure 2:
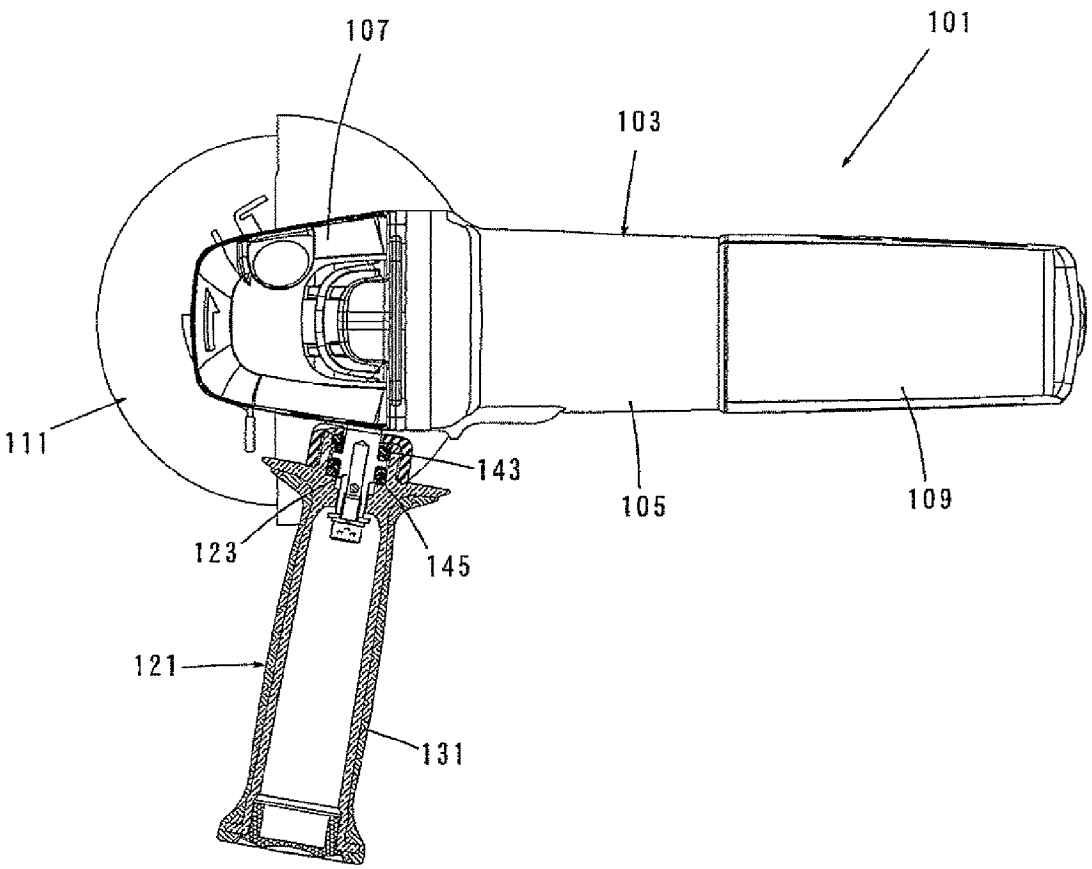
FIG. 2 shows a top view of the disk grinder, especially shows a cross-sectional view of the side handle.

Each of the additional features and method steps disclosed above and below may be utilized separately or in conjunction with other features and method steps to provide and manufacture improved a power tool and method for using such the power tool and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Next, an embodiment of the invention will be explained with reference to FIG. 1 to FIG. 8. In this embodiment, the invention will be explained by applying to an electrical disk grinder as one example of a power tool. First, an outline of the electrical disk grinder 101 will be explained with reference to FIG. 1 and FIG. 2. The electrical disk grinder 101 (hereinafter called a grinder 101) is mainly provided with a body 103 as a power tool body which defines an outer surface of the grinder, and a grinding disk 111 as a tool which is attached at a front side of the body 103. The body 103 is mainly provided with a motor housing 105, a gear housing 107 which is connected to one side of the motor housing 105 and a rear cover 109 which is connected to the other side of the motor housing 105.

A motor is provided in the motor housing 105 which is formed like a cylinder. A power transmission mechanism is provided in the gear housing 107 which is connected to a front side of the motor housing 105. The motor and the power transmission mechanism are not shown for convenience. The power transmission mechanism is provided with a plurality of gears which transmit a torque of the motor to the grinding disk 111. The torque of the motor is transmitted to the grinding disk 111 as a rotational motion in a circumference direction of the grinding disk 111. The grinding disk 111 is provided at a front side of the body 103 with respect to a longitudinal direction of the body 103 such that a rotational axis of the grinding disk 111 perpendicularly crosses the longitudinal direction (a direction of a rotational axis of the motor).

The rear cover 109 formed like a cylinder is connected to a rear side of the motor housing 105 (a left side of FIG. 1). A side handle 121, defined as a vibration reduction handle, is detachably attached to a side surface of the gear housing 107. The motor housing 105 and the rear cover 109 is provided such that its longitudinal direction aligns with the longitudinal direction of the body 103. On the other hand, the side handle 121 is attached so as to its longitudinal direction crosses the longitudinal direction of the body 103. Further, a main handle held by a user is defined by the motor housing 105 and the rear cover 109.

When the user turns on a switch provided on the main handle the motor is driven, therefore the grinding disk 111 is driven via the power transmission mechanism. The switch is not shown for convenience. The user holds the main handle by its one hand and the side handle 121 by the other hand, and operates a grinding operation or a cutting operation like that against a workpiece by using the grinding disk 111.

Next, the side handle of this embodiment will be explained with reference to FIG. 3 to FIG. 8. The side handle is an elongate member which extends in a lateral direction crossing the longitudinal direction of the body 103 (refer to FIGS. 1 and 2). The side handle 121 is mainly provided with a handle body 123 which is detachably connected to a side handle connecting portion provided on a side surface of the gear housing 107, and a grip portion 131 formed like a cylinder which is connected to the handle body 123. The handle body 123 corresponds to an attachment portion of the invention. The grip portion 131 corresponds to a grip portion of the invention. Further, the side handle connecting portion includes a threaded screw hole which extends in a direction perpendicularly crossing to the longitudinal direction of the body 103. The threaded screw hole is not shown for convenience.

A detailed construction of the side handle 121 is shown in FIG. 3 to FIG. 6. The handle body 123 is formed as a shoulder column member which has a column portion 125, a connecting screw portion 127 and a screw connected portion 129. The column portion 125 is formed as a cylinder and arranged in a center portion of the handle body 123 with respect to its longitudinal direction. The connecting screw portion 127 is arranged at one side of the column portion 125 and has a screw thread so that a diameter of a screw is smaller than a diameter of the column portion 125. The screw connected portion 129 is arranged at the other side of the column portion 125 so that a diameter of the screw connected portion 129 is smaller than the diameter of the column portion 125. The handle body 123 is detachably attached to the gear housing 107 by means of fastening the connecting screw portion 127 with the threaded screw hole of the gear housing 107. The column portion 125 corresponds to a grip connecting portion of the invention.

The grip portion 131 is formed as a hollowed elongate member and provided with a grip body 133, a cylindrical portion 135 and a stopper flange 137. The grip body 133 is adapted to be held by the user and formed as a cylinder which extends in its longitudinal direction. The cylindrical portion 135 is formed as a cylinder and arranged at one side of the grip body 133 with respect to the longitudinal direction of the grip portion 131. The stopper flange 137 is arranged between the grip body 133 and the cylindrical portion 135 and protrudes toward outward in a radial direction of the grip body 133. The cylindrical portion 135 corresponds to an attachment connecting portion of the invention. Further, the grip body 133 has a regulating wall 139 which regulates the grip body 133 uncoupled from the handle body 123. The regulating wall 139 has a through-hole at its center and arranged in the grip body 133 nearby a boundary to the stopper flange 137. The longitudinal direction of the grip portion 131 corresponds to a first direction of the invention. Further, the stopper flange 137 corresponds to a flange portion of the invention.

The column portion 125 is inserted and fixed in the cylindrical portion 135 so as to be generally aligned coaxially to each other. Therefore, an inside surface 135*a* of the cylindrical portion 135 and an outside surface 125*a* the column portion 125 face to each other with respect to a direction crossing the longitudinal direction of the grip portion 131. The outside surface 125*a* corresponds to a first wall and the inside surface 135*a* corresponds to a second wall of the invention. Further, the screw connected portion 129 is inserted in the through-hole of the regulating wall 139. The screw connected portion 129 penetrates the regulating wall 139 and protrudes into an inner space of the grip body 133. The screw connected portion 129 is screwed with respect to its longitudinal direction by means of a screw 132 via a washer 132*a*. Therefore, the handle body 123 is prevented from uncoupling from the grip portion 131. The direction crossing the longitudinal direction of the grip portion 131 corresponds to a second direction of the invention.

A flange 126 is provided on the outside surface 125*a* and protrudes to outward with respect to a radial direction of the handle body 123. The flange 126 is disposed at a center part of the outside surface 125*a* with respect to the longitudinal direction of the handle body 123. A length of the flange 126 is formed so as not to reach the cylindrical portion 135, when the column portion 125 is fixed inside the cylindrical portion 135. Further, an inner wall portion 136 is provided at a closer side of the grip body 133 with respect to a longitudinal direction of the column portion 135. The inner wall portion 136 is provided so as to protrude to inward in a radial direction of the cylindrical portion 135. Further, a covering cap 141 is covered and fixed on an outside of the cylindrical portion 135. The covering cap 141 includes a top panel 141*a* having a through-hole which penetrating the top panel 141*a* with respect to the longitudinal direction of the grip portion 131. An internal thread is formed on an inside surface of the covering cap 141, therefore the covering cap 141 is fixed via an engagement of the internal thread and an outer thread formed on an outside surface of the cylindrical portion 135. When the covering cap 141 is engaged with the cylindrical portion 135, at least the connecting screw portion 127 of the handle body 123 is protruded toward outside of the covering cap 141 via the through-hole of the top panel 141*a*. The flange 126 corresponds to a flange of the invention. The inner wall portion 136 of the cylindrical portion 135 and the top panel 141*a* of the covering cap 141 respectively correspond to a third wall of the invention. Further, the flange 126 of this embodiment is not only formed as a wall which continuously extends in the circumference direction, but also formed as a plurality of walls which frequently or irregularly align in the circumference direction.

In an engagement area of the cylindrical portion 135 and the column portion 125, two ring-shaped spaces are provided at both side of the flange 126 with respect to the longitudinal direction of the grip portion 131. Namely, one ring-shaped space is surrounded by one side surface of the flange 126, the outside surface 125*a*, the inside surface 135*a* and the top panel 141*a* and the other ring-shaped space is surrounded by another side surface of the flange 126, the outside surface 125*a*, the inside surface 135*a* and the inner wall portion 136. A first vibration reduction rubber 143 and a second vibration reduction rubber 145 are respectively formed as a ring-shaped rubber and respectively arranged at the ring-shaped space. The first vibration reduction rubber 143 corresponds to a first elastic member and the second vibration reduction rubber 145 corresponds to a second elastic member of the invention respectively. Further, the respective shapes, features, characteristics and so on of the first and second vibration rubber 143, 145 are set as same as each other.

The first and second vibration reduction rubber 143, 145 are respectively arranged at the ring-shaped spaces between the handle body 123 and the grip portion 131 so as to contact to walls which surround the ring-shaped spaces. Namely, the first and second vibration reduction rubber 143, 145 are clamped in the cross direction crossing the longitudinal direction of the grip portion 131 by the inside surface 135*a* and the outside surface 125*a* facing to each other. Further, the first vibration reduction rubber 143 is clamped in the longitudinal direction of the grip portion 131 by the side surface of the flange 126 and the inner wall portion 136. The second vibration reduction rubber 145 is clamped in the longitudinal direction of the grip portion 131 by the other side surface of the flange 126 and the top panel 141*a*.

Figure 6:
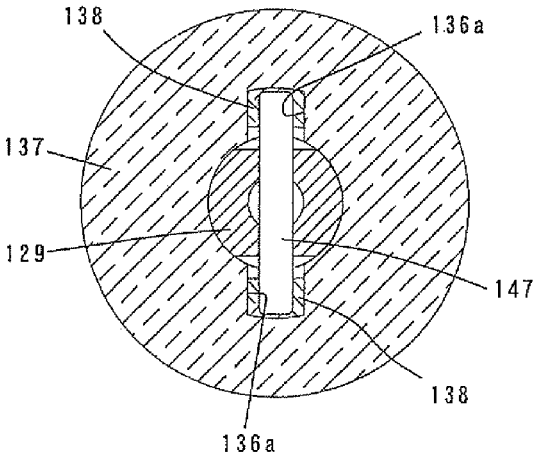
FIG. 6 shows a cross-sectional view taken from line B-B of FIG. 4.
Figure 7:
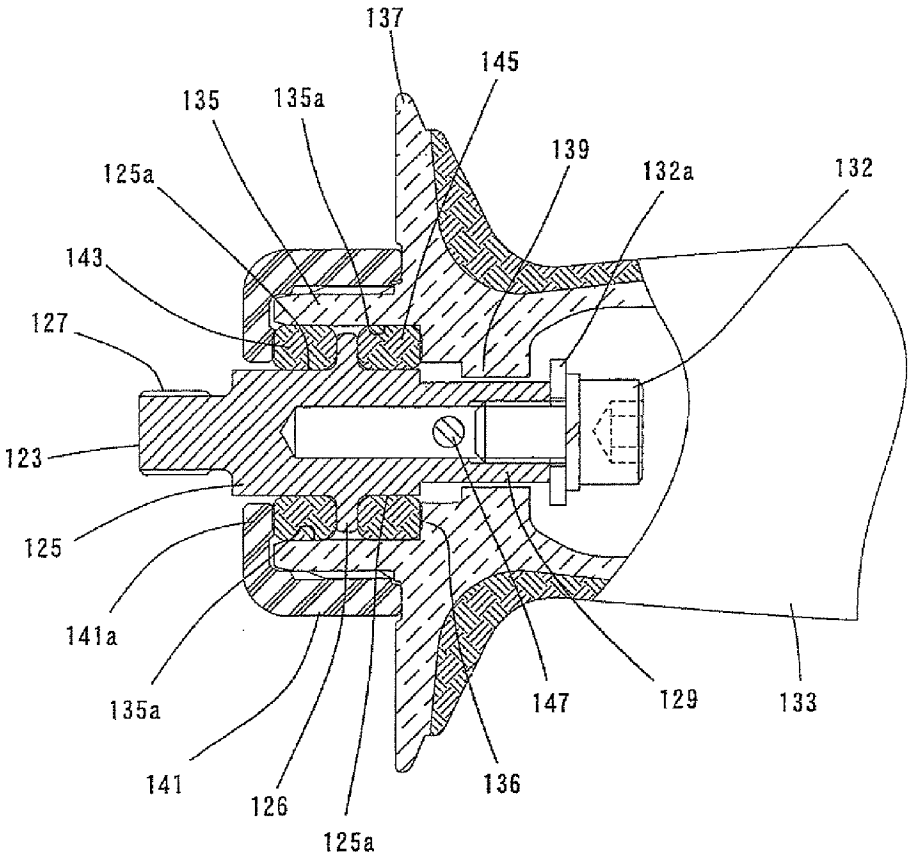
FIG. 7 shows an enlarged view of a connecting portion of a handle body and a grip when the side handle is in an upright position.

A pin 147 is provided at the screw connected portion 129 through which the pin 147 penetrates the screw connected portion 129 and protrudes in a radial direction of the screw connected portion 129. As shown in FIG. 6, a protruding portion of the pin 147 is indirectly engaged with a recess 136*a* of the cylindrical portion 135 which is formed toward the radial direction of the cylindrical portion 135. Therefore, the grip portion 131 is regulated to rotate against the handle body 123 in a circumference direction of the handle body 123. Namely, when the pin 147 is assembled to the gear housing 107 by means of screwing the connecting screw portion 127 into the threaded screw hole of the gear housing 107, the pin 147 makes the grip portion 131 and the handle body 123 rotate together.

Figure 3:
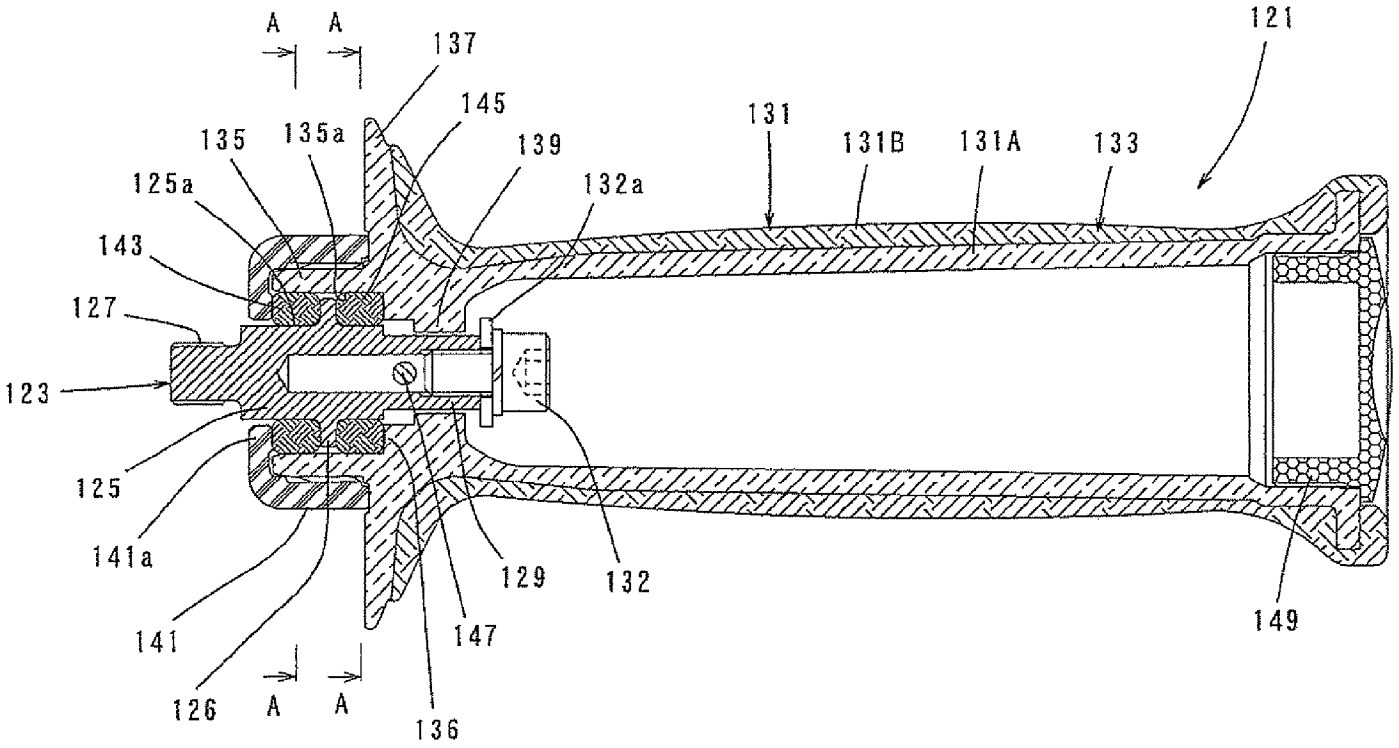
FIG. 3 shows a cross-sectional view of the side handle.

As shown in FIG. 3, the grip portion 131 is provided with an inner member 131A made of hard plastic and an outer member 131B made of elastomer as an elastic member which covers an outside surface of the inner member 131A. Further, the outer member 131B covers the grip portion 133 and an outside surface of the stopper flange 137 which the outside surface is a closer side of the stopper flange 137 to the grip body 133. Accordingly, fit feeling of fingers is improved and preventing fingers from slipping against the grip body 131.

Figure 4:
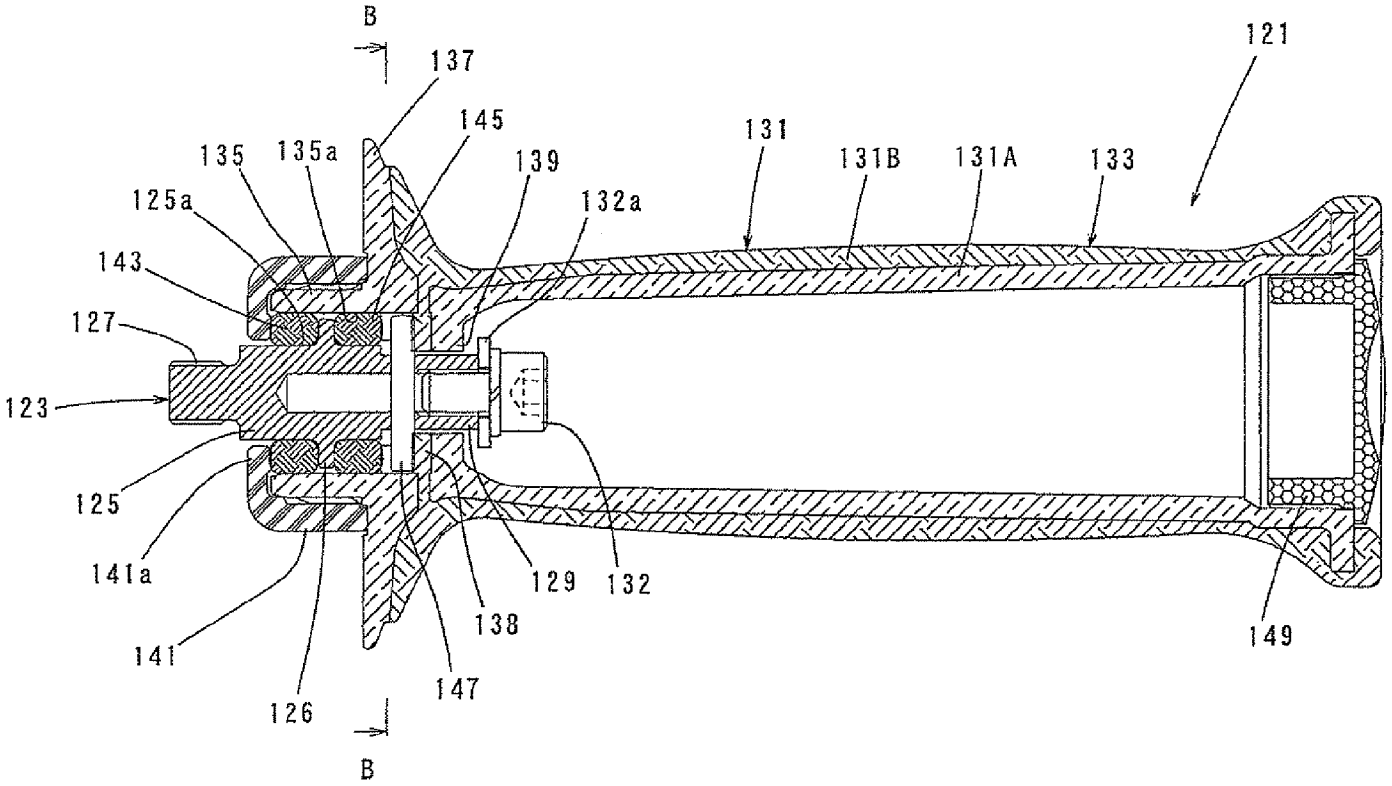
FIG. 4 shows a 90 degrees rotated cross-sectional view around a circumference direction of the side handle from the cross-sectional view of FIG. 3.
Figure 5:
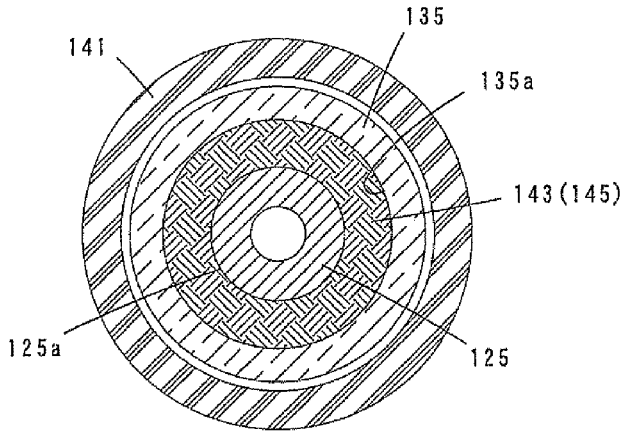
FIG. 5 shows a cross-sectional view taken from line A-A of FIG. 3.

Further, as shown in FIG. 4, the outer member 131B has an extending portion 138 which extends to the recess 136*a* through the through-hole of the regulating wall 139. The protruding portion of the pin 147 which protrudes from the screw connected portion 129 is supported by the extending portion 138. Namely, in this embodiment, the pin 147 is supported by the extending portion 138 of the outer member 131B, and the grip portion 131 is indirectly connected to the handle body 123, therefore a vibration of the handle body 123 is not transmitted to the grip portion 131 via the pin 147. Further, an opening of a front side of the grip portion 131 is covered by a stopper 149. The stopper 149 is provided by a metal weight.

The side handle 121 of this embodiment is comprised as described above. Accordingly, when the grip portion 131 is exerted by an external force in a state that the disk grinder 101 operates a grinding operation against the workpiece, namely when the grip portion 131 is exerted by the external force in the direction crossing the longitudinal direction of the grip portion 131, the grip portion 131 is pivoted against the handle body 123 around a pivot arranged between the first vibration reduction rubber 143 and the second vibration reduction rubber 145 (approximately center of the flange 126). The pivot of the grip portion 131 is shown as symbol O in FIG. 8.

Figure 8:
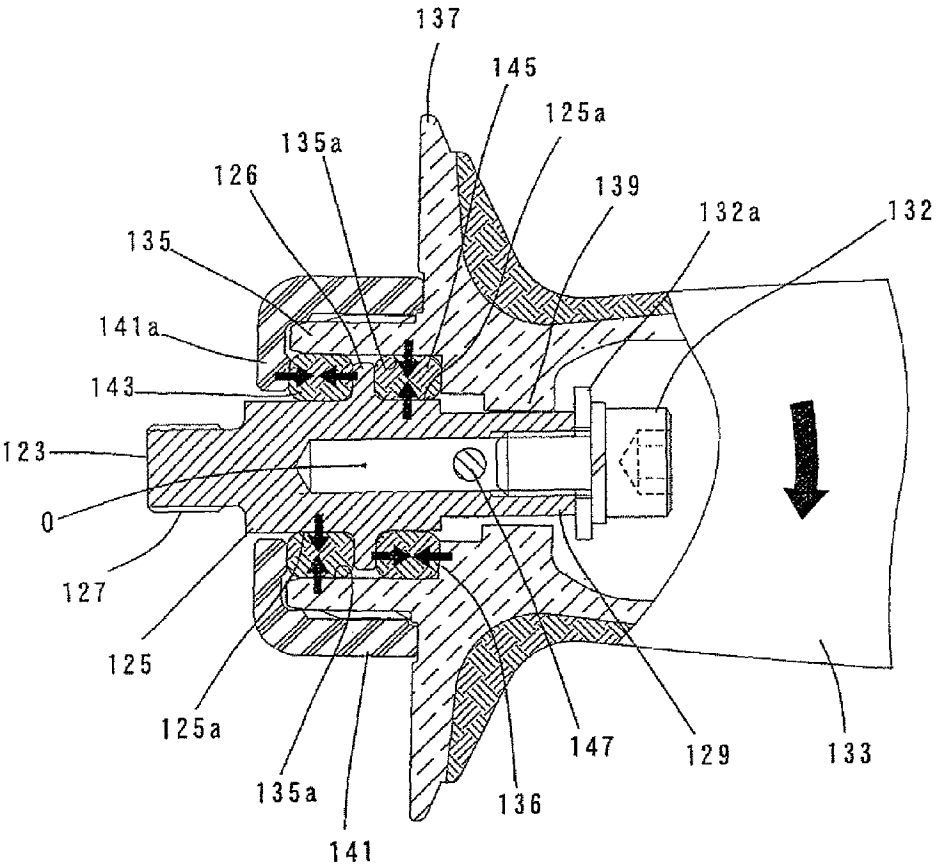
FIG. 8 shows an enlarged view of the connecting portion of the handle body and the grip when the side handle is pivoted.
Figure 9:
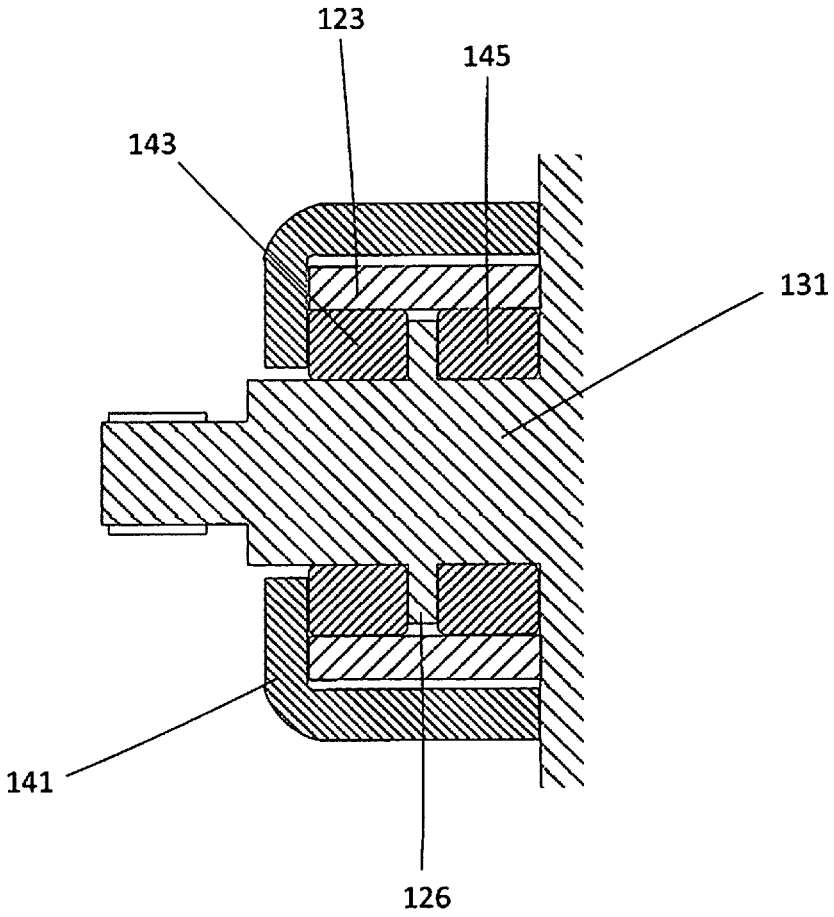
FIG. 9 shows an enlarged view of an alternative embodiment of the connecting portion of the handle body and the grip.

As shown in FIG. 8, when the grip portion 131 is pivoted around the pivot O, an one side part of the first vibration reduction rubber 143 (lower side of FIG. 8) with respect to the longitudinal direction of the grip portion 131 is compressed by the inside surface 135*a* and the outside surface 125*a* in the radial direction of the grip portion 131 together with a displacement of the inside surface 135*a* getting closer to the outside surface 125*a*. Further, the other side part of the first vibration reduction rubber 143 (upper side of FIG. 8) is compressed by the top panel 141*a* and a side surface of the flange 126 in the longitudinal direction of the grip portion 131 together with a displacement of the top panel 141*a* getting closer to the side surface of the flange 126.

On the other hand, a part of one side of the second vibration reduction rubber 145 (upper side of FIG. 8) with respect to the longitudinal direction of the grip portion 131 is compressed by the outside surface 125*a* and the inside surface 135*a* in the radial direction of the grip portion 131 together with a displacement of the inside surface 135*a* getting closer to the outside surface 125*a*. Further, the other side part of the second vibration reduction rubber 145 (lower side of FIG. 8) is compressed by the top panel 141*a* and an another side surface of the flange 126 in the longitudinal direction of the grip portion 131 together with a displacement of the top panel 141*a* getting closer to the another side surface of the flange 126.

According to this embodiment described above, the first vibration reduction rubber 143 and the second vibration reduction rubber 145 are utilized so as to be substantially compressively deformed. Namely, the first and second vibration reduction rubber 143, 145 reduce vibration by means of compressive deformations of approximately whole part of the first and second vibration reduction rubber 143, 145. Therefore, an effect of vibration reduction is improved. Accordingly, each volume of the first and second vibration reduction rubber 143, 145 is decreased respectively. Therefore, the side handle 101 is lightened and downsized. Further, in this embodiment, because compressive deformations of the first and second vibration reduction rubber 143, 145 are utilized, degradations of the first and second vibration reduction rubber 143, 145 are more effectively prevented than a state that shear deformations are utilized.

Further, according to this embodiment, the first and second vibration reduction rubber 143, 145 are formed as other component separately each other. Therefore, the first and second vibration reduction rubber 143, 145 are assembled easily to arrange at one side of the flange 126 and the other side of the flange 126 respectively. On the other hand, the first and second vibration reduction rubber 143, 145 may be formed as one combined component.

Further, according to this embodiment, the grip portion 131 and the handle body 123 are arranged separately each other and connected via the first and second vibration reduction rubber 143, 145. Namely, because the grip portion 131 and the handle body 123 are arranged separately each other and the handle body 123 and the grip portion 131 are connected each other via only the first and second vibration reduction rubber 143, 145, in an area other than where the first and second vibration reduction rubber 143, 145 are arranged, the handle body 123 and the grip portion 131 are separated from each other (called floating support). Therefore, a directly-transmission of vibration from the handle body 123 to the grip portion 131 is decreased.

Further, according to this embodiment, because the stopper flange 137 is disposed between the cylindrical portion 135 and the grip body 133 with respect to the longitudinal direction of the grip portion 131, the grip body 133 is disposed distantly from the cylindrical portion 135 with respect to the longitudinal direction. Therefore, a damping effect of a vibration of the grip body 133 is effectively improved.

Attaching the side handle 121 to the grinder 101 in this embodiment is achieved to rotate the connecting screw portion 127 of the handle body 123 in a circumference direction of the grip portion 131 and screw into the threaded screw hole formed at a body portion of the grinder 101 (the gear housing 107). In this case, a relative rotation between the handle body 123 and the grip portion 131 is regulated by the pin 147. Therefore, the side handle 121 is mounted steadily on the body 103 of the grinder 101 and shearing force is not exerted on the first and second vibration reduction rubber 143, 145 when a torque is adapted to the grip portion 131 to mount the side handle 121 on the body 103.

Further, as to a connecting construction of the handle body 123 and the grip portion 131 described above, another connecting construction inverting positions of the handle body 123 and the grip portion 131 may be also adapted into the invention. Namely, a connecting portion of the handle body 123 may be formed as a cylinder and a connecting portion of the grip portion 131 may be formed as a column-shaped portion. In this way, the connecting portion of the handle body 123 is disposed outside of the connecting portion of the grip portion 131 herewith the connecting portion of the handle body 123 and the connecting portion of the grip portion 131 are fixed each other. In this connection, the flange 126 is provided on the connecting portion of the grip portion 131 and the connecting portion of the handle body 123 is covered by the covering cap 131. Further, the first and second vibration reduction rubber 143, 145 are provided between the connecting portion of the handle body 123 and the connecting portion of the grip portion 131, therefore the connecting portion of the handle body 123 and the connecting portion of the grip portion 131 are connected to each other. Said another connecting construction of the side handle also achieves similar effects as the embodiment described above.

The side handle 121 is adapted to the grinder 101 in this embodiment, however the side handle 121 may be adapted to not only the grinder 101 but also a power tool such as an electric hammer, a hammer drill and so on which produce a vibration on its tool body in a state that the power tool is operating.

Having regard to an aspect of the invention, following features are provided:

(Feature 1)

The vibration reduction handle according to any one of claims 1 to 4, wherein the first elastic member and the second elastic member reduce a transmission of vibration by compressively deforming of substantially whole parts of the first elastic member and the second elastic member in the state that the grip portion pivots against the attachment portion around the pivot.

(Feature 2)

The vibration reduction handle according to any one of claims 1 to 9, wherein the attachment portion has a pin to regulate a relative rotation between the attachment portion and the grip portion around the first direction, wherein a third elastic member is provided between the pin and the grip portion.

DESCRIPTION OF NUMERALS

101 disk grinder
103 body
105 motor housing
107 gear housing
109 rear cover
111 grinding disk
121 side handle
123 handle body
125 column portion
125*a* outside surface
126 flange
127 connecting screw portion
129 screw connected portion
131 grip portion
132 screw
133 grip body
135 cylindrical portion
135*a* inside surface
136 inner wall portion
136*a* recess
137 stopper flange
138 extending portion
139 regulating wall
141 covering cap
141*a* top panel
143 first vibration reduction rubber
145 second vibration reduction rubber
147 pin
149 stopper

What is claimed is:

1. A vibration reduction handle comprising:

an attachment portion attachable to a power tool;

a grip portion which extends in a first direction defined as a longitudinal direction of the grip portion and is pivotably movable in a second direction crossing the first direction; and a first ring-shaped elastic member and a second ring-shaped elastic member which are respectively provided between the attachment portion and the grip portion, wherein the attachment portion has a grip connecting portion which engages with the grip portion and has a first wall, wherein the grip portion has an attachment connecting portion which engages with the attachment portion and has a second wall, wherein one component among the grip connecting portion and the attachment connecting portion is disposed inside an other component, and the first wall and the second wall face to each other, and said one component has a flange which protrudes along the second direction toward the other component, and the other component has a third wall which faces respectively both surfaces of the flange with respect to the first direction, wherein the first elastic member and the second elastic member are respectively disposed at both sides of the flange with respect to the first direction and clamped by the first wall and the second wall in the second direction and clamped by the flange and the third wall in the first direction, wherein the grip portion includes a pivot against the attachment portion disposed between the first elastic member and the second elastic member with respect to the first direction.

2. The vibration reduction handle according to claim 1, wherein the grip connecting portion is disposed inside the attachment connecting portion, wherein the flange is provided on the grip connecting portion and protrudes toward the attachment connecting portion, wherein the third wall is provided on the attachment connecting portion.

3. The vibration reduction handle according to claim 1, wherein the attachment connecting portion is disposed inside the grip connecting portion, wherein the flange is provided on the attachment connecting portion and protrudes toward the grip connecting portion, wherein the third wall is provided on the grip connecting portion.

4. The vibration reduction handle according to claim 1, wherein the first elastic member and the second elastic member are provided as other component separately each other.

5. The vibration reduction handle according to claim 1, wherein the first wall and the second wall exert a compression force against the first elastic member and the second elastic member in a state that the grip portion pivots against the attachment portion.

6. The vibration reduction handle according to claim 5, wherein the third wall exerts a compression force against the first elastic member and the second elastic member in a state that the grip portion pivots against the attachment portion.

7. The vibration reduction handle according to claim 1, wherein the attachment portion and the grip portion are distantly positioned and connected to each other via the first elastic member and the second elastic member.

8. The vibration reduction handle according to claim 1, wherein the grip portion has a grip body which extends in the first direction and which connects to the attachment connecting portion, and wherein the grip portion has a flange portion which is disposed between the attachment connecting portion and the grip body.

9. A power tool has the vibration reduction handle according to claim 1.

10. A vibration reduction handle comprising:

an attachment portion which attachable to a power tool;

a grip portion which extends in a first direction defined as a longitudinal direction of the grip portion and is pivotably movable in a second direction crossing the first direction; and a first ring-shaped elastic member and a second ring-shaped elastic member which are provided between the attachment portion and the grip portion, wherein the first elastic member and the second elastic member are substantially aligned to each other along the first direction, wherein the grip portion includes a pivot against the attachment portion disposed between the first elastic member and the second elastic member with respect to the first direction, wherein the attachment portion and the grip portion exert a compression force against both of the first elastic member and the second elastic member in a state that the grip portion pivots.

11. A vibration reduction handle comprising:

an attachment portion attachable to a power tool;

a covering cap;

a grip portion which extends in a first direction defined as a longitudinal direction of the grip portion and is pivotably movable in a second direction crossing the first direction; and a first elastic member and a second elastic member which are respectively provided between the attachment portion and the grip portion, wherein the attachment portion has a grip connecting portion which engages with the grip portion and has a first wall, wherein the grip portion has an attachment connecting portion which engages with the attachment portion and has a second wall, wherein one component among the grip connecting portion and the attachment connecting portion is disposed inside an other component, and the first wall and the second wall face to each other, and said one component has a flange which protrudes along the second direction toward the other component, and the other component has a third wall which faces respectively both surfaces of the flange with respect to the first direction, wherein the first elastic member and the second elastic member are respectively disposed at both sides of the flange with respect to the first direction and clamped by the first wall and the second wall in the second direction and clamped by the flange and the third wall in the first direction, wherein the grip portion includes a pivot against the attachment portion disposed between the first elastic member and the second elastic member with respect to the first direction, wherein the third wall includes the other component and the covering cap.

12. The vibration reduction handle according to claim 1, wherein the one component has a connecting screw portion and a screw connected portion configured to connect the vibration reduction handle and the power tool.

* * * * *